United States Patent [19]

Sukenik

[11] Patent Number: 4,531,996

[45] Date of Patent: Jul. 30, 1985

[54] SINGLE FACER CORRUGATING MACHINE

[75] Inventor: Robert J. Sukenik, Bloomfield Hills, Mich.

[73] Assignee: Corrugating Roll Corporation, West Bloomfield, Mich.

[21] Appl. No.: 608,466

[22] Filed: May 9, 1984

[51] Int. Cl.[3] ..... B31F 1/28

[52] U.S. Cl. ..... 156/472; 156/205; 156/210; 156/582; 425/367; 425/369

[58] Field of Search ..... 156/205, 210, 472, 553, 156/582; 425/336, 363, 366, 367, 269

[56] References Cited

U.S. PATENT DOCUMENTS

| | | | |
|---|---|---|---|
| 1,263,000 | 4/1918 | Swift | 425/369 |
| 1,587,963 | 6/1926 | Knopf . | |
| 1,642,782 | 9/1927 | Langston | 425/369 |
| 1,870,473 | 8/1932 | Tumulty et al. | 156/205 |
| 1,892,812 | 1/1933 | Rous | 425/369 X |
| 2,163,063 | 6/1939 | Romanoff | 425/369 X |
| 2,576,281 | 11/1951 | Carr | 425/369 |
| 2,742,079 | 4/1956 | Hall | 425/369 |
| 3,671,361 | 6/1972 | Morrison | 156/472 |
| 3,676,268 | 7/1972 | Brandenburg et al. | 156/210 X |
| 3,730,803 | 5/1973 | Morrison | 156/205 |
| 3,919,029 | 11/1975 | Osgood | 156/205 |
| 3,947,206 | 3/1976 | De Ligt et al. | 425/369 X |
| 4,080,878 | 3/1978 | Gallagher et al. | 425/363 X |
| 4,177,102 | 12/1979 | Tokuno | 425/369 X |
| 4,202,719 | 5/1980 | Linn | 156/205 |
| 4,245,975 | 1/1981 | Hattori | 425/369 X |
| 4,381,212 | 4/1983 | Roberts | 425/369 X |
| 4,447,285 | 5/1984 | Lussana et al. | 425/369 X |

*Primary Examiner*—J. Howard Flint, Jr.

*Attorney, Agent, or Firm*—Harness, Dickey & Pierce

[57] ABSTRACT

A single facer corrugating machine having an elongated fluted roller, a series of fluted roll segments which cooperate with the fluted roller to form a corrugated paper medium, and a series of smooth surfaced pressure roll segments which cooperate with the fluted roller to facilitate application of a liner to the corrugated medium to yield a single faced corrugated paper product. Each of the roll segments is independently supported and can be independently positively located relative to the fluted roller. The roll segments can be nip loaded independently of one another, and each roll segment is independently position adjustable relative to the fluted roller to facilitate phase control across the width of the machine of roll interactions associated with corrugation formation and liner application to control and reduce overall machine noise and vibration.

85 Claims, 16 Drawing Figures

Fig-12
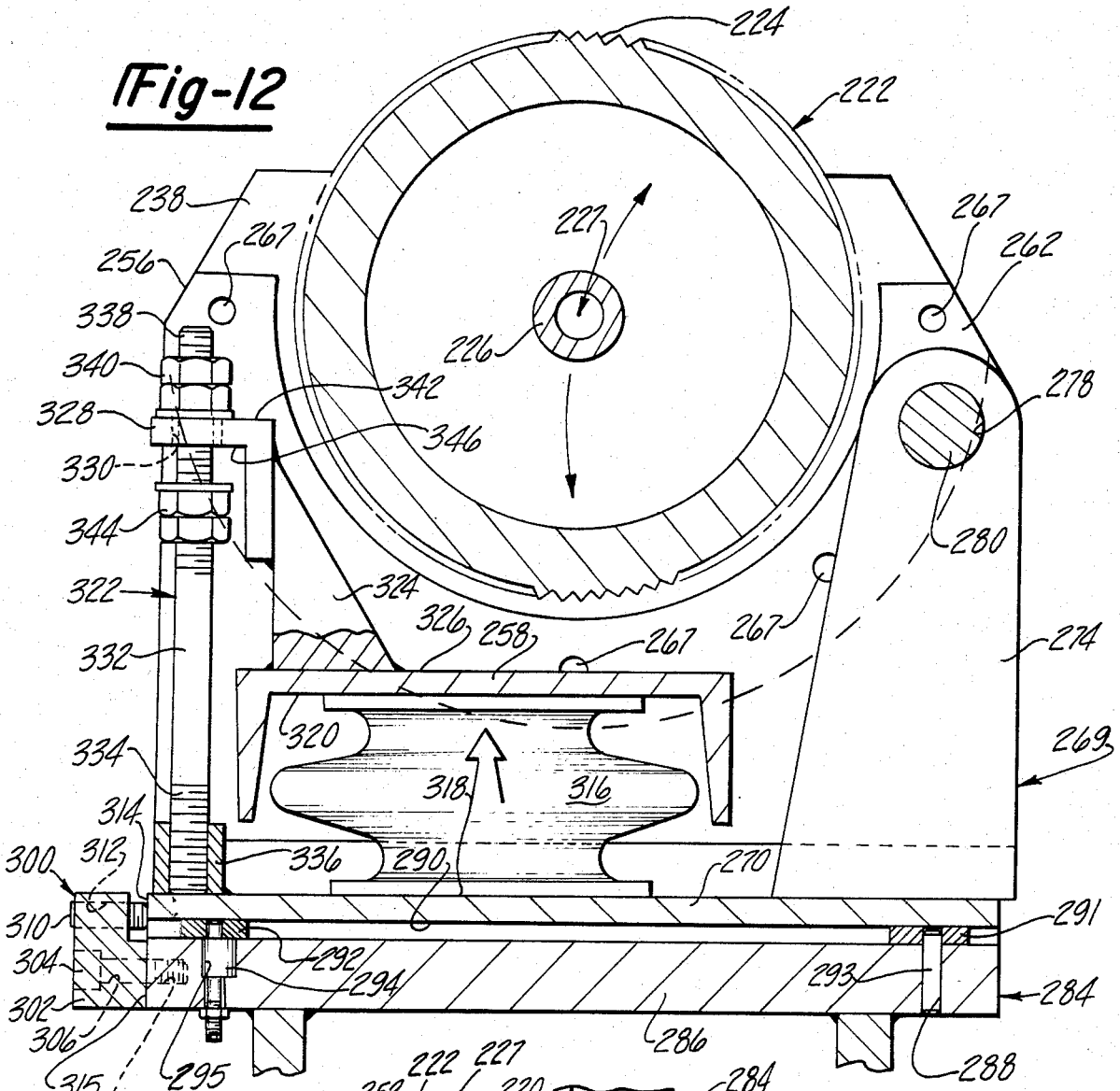
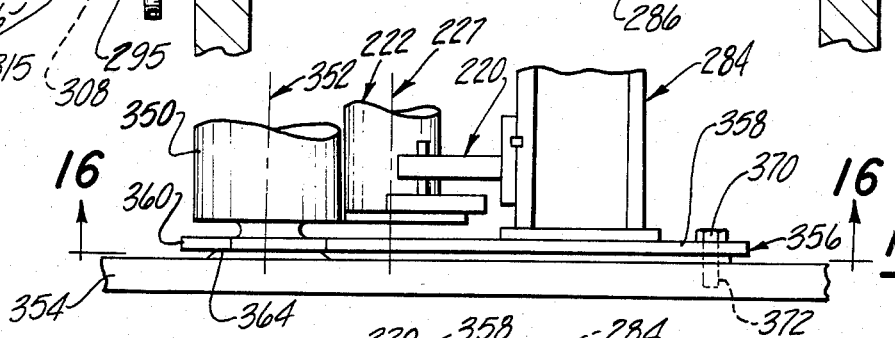
Fig-15
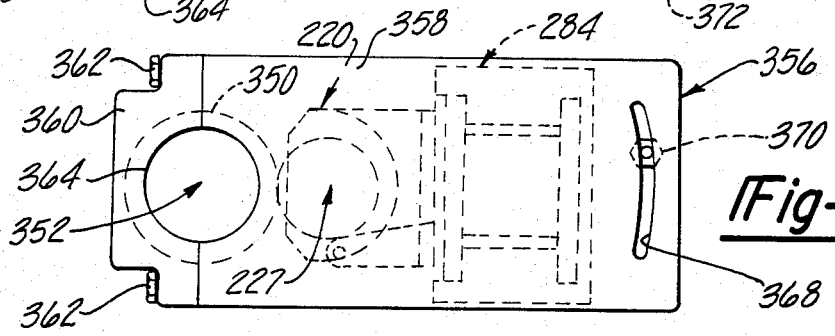
Fig-16

SINGLE FACER CORRUGATING MACHINE

BACKGROUND AND SUMMARY OF THE INVENTION

The present invention relates to corrugating machines utilized in the manufacture of single faced corrugated paper products, and more particularly to an improved corrugating machine design which significantly reduces particular operating problems prevalent in conventional single facer machines.

Conventional "single facer" corrugating machines have included a pair of fluted rolls of substantial mass supported on bearings at each end (generally termed upper and lower corrugating rolls). The corrugating rolls include elongated intermeshing flutes which cooperate to deform a paper medium passed between them to provide corrugations in the medium. Such conventional machines also include a smooth surface "pressure roll" located adjacent and biased toward the periphery of the lower corrugating roll for applying a paper liner to the adhesively treated tips of the corrugated medium to yield a single faced product.

One problem encountered with such conventional machines relates to their adaptability to different operating conditions. In order to provide a more even corrugating force (nip pressure) across the width of such machines, the upper corrugating roll is generally crowned. The manufacture of a crowned roll shape is an expensive and time-consuming process, and changing rolls can be a similarly time-consuming and expensive process. Thus, the selection of roll crowns and related nip pressures is usually based upon estimated operating conditions for the most commonly used thicknesses and grades of medium and liner. However, when a box plant changes to paper specifications that yield machine operating conditions which deviate substantially from normal estimates, machine speeds often have to be reduced because the nip pressures are not optimum for the particular grades of paper being run through the machine. Moreover, if the medium is less than the full width of the machine, nip pressures must ordinarily be reduced to avoid metal to metal contact and possible damage to the ends of the corrugating rolls.

A further problem associated with conventional single facer machines relates to the damage sometimes caused by foreign objects carried into and through the nip of one or more of the rolls. Such damage can occur because of the large mass of the rolls, as well as the associated nip pressures applied to the rolls during the medium flute forming and liner applications processes. Typically, a point load will occur when a foreign object such as a tool goes through the nip center line defined by and extending between adjacent rolls. This point load will either require movement of the rolls to accomodate the dimensions of the foreign object, or deformation of the rolls, resulting in bending or breaking of roll flutes. However, the large mass and high loading of conventional rolls typically prevents such roll movement, so that flute damage is usually the result. Such conventional rolls are expensive to machine or replace, so that roll repair and/or replacement due to such damage can be a costly event.

An additional disadvantage associated with such conventional machines relates to the general operative environment surrounding them. As is well known, conventional corrugating machines create a high level of machine noise and vibration, and ear protection is thus usually required during machine operation. The noise and vibration in such machines is discreet in frequency, and the primary sources are traceable to the interactions between the upper and lower corrugating rolls, and to the interactions between the lower corrugating roll and the pressure roll. One source of such noise and vibration is traceable to machine forces which cause the lower corrugating roll to deflect in the direction of the pressure roll, resulting in impacts between the flutes of the lower corrugating roll and the pressure roll. Another source of noise and vibration is the medium flute forming process, which is effected in conventional machines simultaneously across the entire width of the medium. Attempts have been made to reduce such noise by providing corrugating rolls having curved flutes or rolls which are skewed relative to one another, to effect a non-simultaneous formation of flutes across the width of the medium. However, such designs add to machine complexity and/or roll machining occurs, or produce a non-standard product, and do nothing to reduce the above-noted problem of substantial roll mass and adaptability of such machines to different medium requirements.

A further problem associated with conventional single facer machines relates to uneven roll wear patterns created by the flute forming process. More particularly, over a period of time, the corrugating and pressure rolls will exhibit wear because the paper run through the machine is abrasive in nature. Yet the paper will vary in width in most box plants, and the average medium width will typically be less than the full width of the rolls. Roll wear will occur only where the medium runs through the machine, so that the corrugating and pressure rolls will typically exhibit a reduction in diameter generally in their middle zones under typical operating conditions, and suffer little diameter reduction at their longitudinal ends. When diameter reduction in the middle zone of the rolls exceeds the compressed thickness of typical paper medium (generally around 0.006 inches), metal to metal interference contact can occur between the corrugating rolls, with attendant damage to their flutes. Such mechanical interference also has the effect of reducing the nip pressure in the middle zone of the rolls, which can result in inadequate load for proper forming of flutes in the medium. Moreover, uneven wear of the lower corrugating roll and the pressure roll will eventually result in similar metal to metal contact between these two rolls near their longitudinal ends. Such contact tends to deform and damage the tips of the flutes of the lower corrugating roll.

In addition to the above, the efficient operation of single facer machines requires that the location of the rolls relative to one another be maintained to within relatively close tolerances. Thus, for example, it is desirable to locate and maintain the pressure roll so that it just kisses the lower corrugating roll. Moreover, machine noise and vibration, as well as roll wearing, are best reduced if the pressure roll can be located by way of a mechanical stop, rather than by biasing it against the lower corrugating roll. However, under operating conditions, nip loading of the upper corrugating roll tends to deflect the lower corrugating roll into the pressure roll. While the pressure roll is generally preground with a negative crown to attempt to match the most likely machine operating conditions and roll deflections, the use of mechanical stops is very difficult, if not impossible, in conventional machines because several operating factors, such as roll loading, vibration, medium basis weight and width, roll thermal expansion, and roll wear, affect the actual shape of the roll and the amount of roll deflection in any particular operative situation.

As corrugating machine widths and speeds have increased in recent years, the problems of noise and vibration have also increased. It has been found that some conventional machines possess a resonant frequency falling within operating speed ranges of the machine. Thus, when the machine operates anywhere near its resonant frequency, severe increases in vibration and noise levels are observed. In such resonant ranges, these corrugating machines are more highly stressed and the likelihood of mechanical damage or structural failure is increased. Related to the above problem is the fact that machine vibrations created by the corrugating and pressure rolls cause or result in bearing loads which are far more significant than those associated with supporting a smoothly running system. As a result, the bearings and pivots in such conventional machines must be capable of withstanding significantly higher forces than they would otherwise experience in the absence of such vibration. This vibration loading in conventional corrugating machines generally requires high capacity bearings, sometimes of a particular or special design.

For these reasons, increased machine widths have encouraged the use of larger diameter corrugating rolls to provide additional rigidity, and to increase the stiffness and resonant frequency of the machine. However, such larger diameter corrugating rolls are disadvantageous for easy flute forming. The flute forming process in such machines requires the paper medium to be folded and gathered as it moves to the nip center line of the corrugating rolls. Typically, larger diameter corrugating rolls have a more complex labyrinth or "paper path", which can cause high tensions in the medium and result in medium fracturing. Moreover, large diameter corrugating rolls also have been found to operate optimally with large flute tip radii, which increases medium take-up ratio and resulting medium expense.

It is, therefore, desirable to provide a single facer corrugating machine which is more adaptable than prior known single facer corrugating machines to different operating conditions resulting from paper media of various weights, thicknesses and widths, and which can process diverse paper medium weights, thicknesses and widths without reducing machine operating speeds or operating the machine at reduced or non-preferred operating speeds and nip pressures. It is further desirable to provide such a single facer corrugating machine with reduced noise and vibration characteristics as compared with conventional single facer machines. It is also desirable to provide such a single facer corrugating machine which can more readily accommodate foreign objects such as tools which may enter the machine so as to reduce the possibility of roll and/or roll flute damage, as well as the equipment and labor costs associated with such events. It is further desirable to provide such a single facer corrugating machine which allows location of the corrugating and/or pressure roll assemblies by way of mechanical stops more readily than prior known single facer machines. It is also desirable to provide such a single facer corrugating machine which can accommodate roll wearing more readily than prior known machines, and which can be adjusted to compensate for uneven roll wear patterns attendant to machine operation with paper mediums of less than the full width of the machine roll assemblies. It is moreover desirable to provide such a single facer corrugating machine assembly which avoids the necessity of utilizing large diameter corrugating rolls and/or corrugating rolls with large flute tip radii so that operating expenses associated with increased roll cost, and increased medium take-up ratios and/or medium fracturing can be reduced and/or avoided. It is further desirable to provide such a single facer corrugating machine which avoids the necessity of utilizing special or high capacity bearings and pivots so that overall machine manufacturing costs can be reduced.

The present invention is intended to satisfy the above desirable features and objectives through the provision of a new and improved single facer corrugating machine having an elongated fluted lower corrugating roller and a series of fluted roll segments independently supported adjacent the lower corrugating roller at individual stations spaced along the length of the lower corrugating roller and which cooperate therewith to form corrugations in a paper medium passed therebetween. Each of the individual fluted roll segments is supported for rotation about its own discrete axis, and can be nip loaded against the lower corrugating roll independently of the other fluted roll segments. The invention also includes a pressure roll assembly for facilitating application of a liner to the corrugated medium comprised of individual pressure roll segments independently supported at stations spaced along the length of the lower corrugating roll. Each of the pressure roll segments is also supported for rotation about its own distinct axis, and can be nip loaded against the lower corrugating roll independently of the other pressure roll segments. Each of the fluted roll segments and pressure roll segments is positionable relative to the lower corrugating roll independently of its other associated roll segments to facilitate phase control across the width of the machine, and in the machine direction, of roll interactions associated with corrugation formation and liner application for the purpose of controlling and reducing overall machine noise and vibration. Independent stops are also provided for each of the roll segments to allow the mechanical location of the roll segments relative to the lower corrugating roller. Provision is also made for adjusting the parallelism of each roll segment relative to the lower corrugating roll.

The individual roll segment design of the invention also allows for independent positioning of particular roll segments to compensate for uneven roll wear, and independent adjustment of nip loading to optimize operating conditions for paper mediums of diverse widths and thicknesses. The segmented roll design of the invention also yields a machine which avoids the problem of large roller mass, since any individual roll segment can more readily accommodate foreign objects which may find their way into the machine. Moreover, the segmented roll design eliminates the need for special or high capacity bearings and pivots of the type associated with conventional roll assemblies of substantial mass.

The above and other features of the invention will become apparent from a reading of the detailed description of the preferred embodiments, which make reference to the following set of drawings.

BRIEF DESCRIPTION OF THE DRAWINGS

FIG. 12 is a cross-sectional view taken in the direction of Line 12—12 of FIG. 10;

FIG. 15 is a partial schematic view of a further embodiment of the invention; and FIG. 16 is a partial sectional view taken in the direction of Line 16—16 of FIG. 15.

DETAILED DESCRIPTION OF THE PREFERRED EMBODIMENTS

Figure 1:
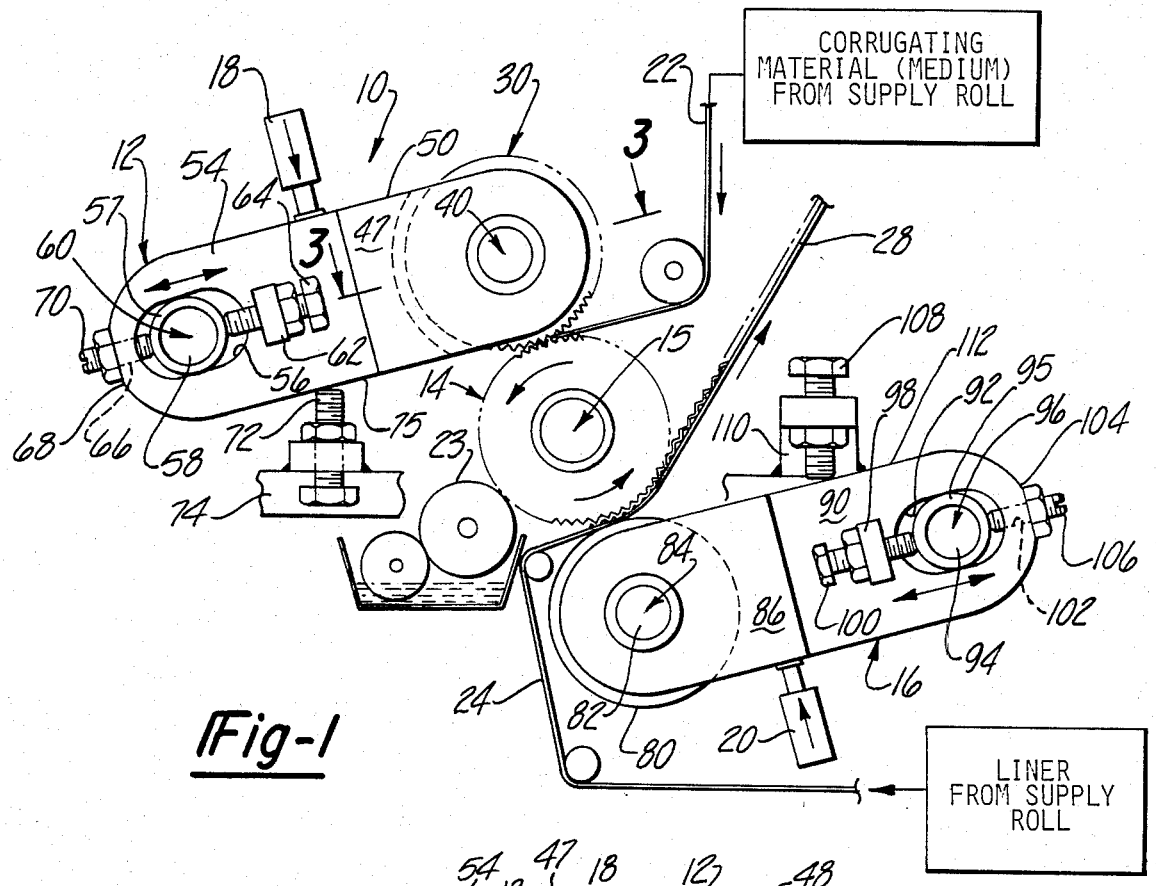
FIG. 1 is an end view in schematic form of a single facer corrugating machine in accordance with the present invention.

Referring now more specifically to the drawings, a generally schematic illustration of a single facer corrugating machine in accordance with the present invention is shown in FIG. 1 at 10. The corrugating machine 10 includes an upper corrugating or forming roller assembly 12 located adjacent a lower corrugating or forming roller 14 which is supported at its opposite ends in a support frame (not shown) for rotation about a roller axis 15. The machine 10 further includes a pressure roller assembly 16 disposed adjacent the lower forming roller 14. Biasing means 18 are provided for nip loading the upper roller assembly 12 toward and/or against the lower forming roller 14, and similar biasing means 20 are provided for nip loading the pressure roller assembly 16 toward and/or against the lower forming roller 14. The upper forming roller assembly 12 is designed to cooperate with the lower forming roller 14 to form corrugations or flutes extending along the width of a paper medium 22 which is fed between upper roller assembly 12 and the lower forming roller 14. The corrugated medium 22, after passing through the nip, is held in position in the flutes of the lower forming roller 14 by various mechanical means such as brass crescent shaped fingers or differential pressure means using vacuum, or positive pressure, or combinations of the same (not shown). Then, a glue roll 23 applies adhesive to the tips of the corrugated medium 22. The corrugated medium 22 is next passed between the lower forming roller 14 and the pressure roller assembly 16 along with a liner 24. As shown in FIG. 1, the pressure roller assembly 16 cooperates with the lower forming roller 14 to bond the adhesive treated corrugated medium 22 and the liner 24 to yield a single faced corrugated paper product 28.

Figure 2:
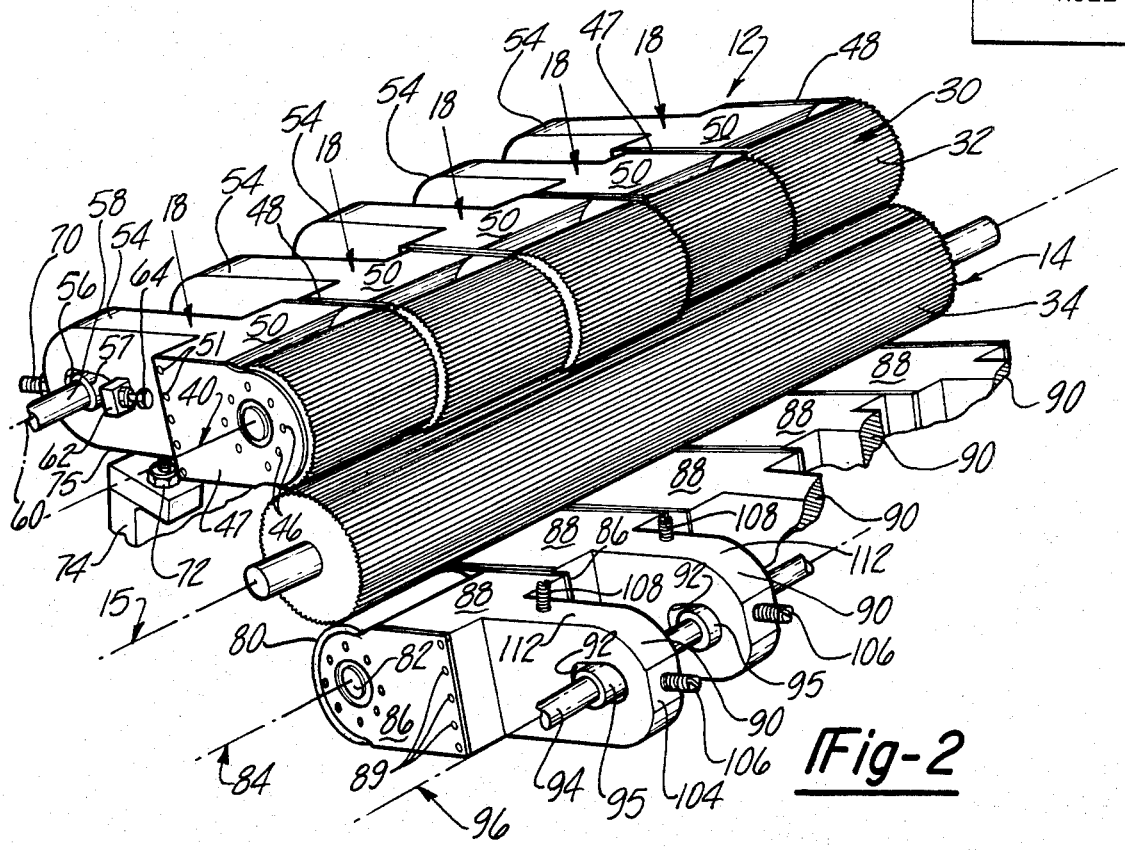
FIG. 2 is a partial perspective view of a corrugating machine in accordance with one embodiment of the present invention.
Figure 3:
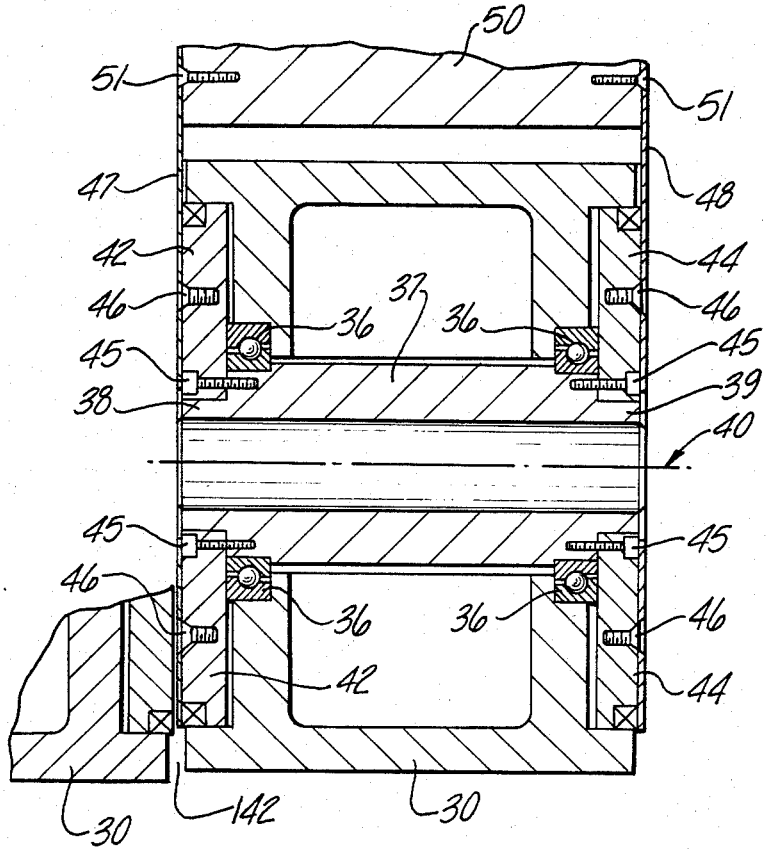
FIG. 3 is a partial sectional view taken generally in the direction of Line 3—3 of FIG. 1.

As shown more clearly in FIGS. 2 and 3, the upper forming roller assembly 12 is comprised of a series of individual forming roll segments 30 which are located at individual stations spaced along the length of the lower forming roller 14. Each of the forming roll segments 30 is formed with longitudinally extending flutes 32 along its outer peripheral surface which are operative to cooperate and intermesh with linear flutes 34 extending along the length of the lower forming roller 14 as shown in FIG. 2. Each of the individual forming roll segments 30 is supported by bearings 36 for rotation about a stepped idler shaft 37, shown in FIG. 3, having reduced diameter ends 38 and 39, and which defines a discrete roll segment axis 40 about which the individual forming roll segment 30 rotates. The forming roll segments 30 are retained against longitudinal movement and supported by way of cover plates 42 and 44 which are fixed to opposite ends of the idler shaft 37 be fasteners 45. The cover plates 42 and 44 are also affixed by fasteners 46 to thin high strength supporting plates 47 and 48, respectively, which are in turn secured to a swing frame 50 by a series of fasteners 51 such as shown in FIGS. 2 and 3.

As shown in FIGS. 1 and 2, each swing frame 50 is formed with an integral elongated pivot arm 54 having a transversely extending aperture 56 designed to receive bearing 57 supporting an elongated pivot shaft 58. The bearing 57 is dimensioned to be received and passed through the apertures 56 in each of the pivot arms 54 of the spaced swing frames 50 so that bearing 57 and the pivot shaft 58 effectively define a pivot axis 60 about which each of the forming roll segments 30 is supported for pivotal movement by its associated swing frame 50. The pivot shaft 58 is supported at its opposite ends and at intermediate positions, if desired, by shaft housings (not shown) so that the pivot axis 60 is disposed in substantially parallel relationship with the roller axis 15 of the lower forming roller 14 in the manner shown in FIG. 2.

The pivot arm 54 of each swing frame 50 is further formed with a laterally depending flange 62 having a threaded aperture for receiving a set screw assembly 64. Each of the swing frames 50 is also formed with a threaded bore 66 extending through the exposed end 68 of pivot arm 54 for receiving a second set screw assembly 70 such as shown in FIG. 1. The set screw assemblies 64 and 70 are operative to engage bearing 57 located upon pivot shaft 58 for fixing the individual swing frames 50 and forming roll segments 30 for pivotal movement about pivot axis 60, with each of the roll segment axes 40 fixed at predetermined radial distances from the pivot axis 60. However, the radial distance between any particular roll segment axis 40 and the pivot axis 60 can be varied and set as desired through manipulation of the set screw assemblies 64 and 70, such as for example, by backing off the set screw assembly 70 and extending the set screw assembly 64 or vice versa. As is readily apparent, such manipulation also enables the machine operator to independently vary the location of each roll segment axis 40 relative to roller axis 15, and thus the nip centerline defined by each roll segment 30 with the lower forming roller 14 as desired.

The upper forming roller assembly 12 also includes a series of adjustable mechanical stop assemblies 72 which are spaced along a supporting frame 74 for individually engaging and positively locating the bottom surface 75 of each pivot arm 54 in the manner shown in FIGS. 1 and 2. The mechanical stops 72 are thus operative to be adjusted as desired for positively locating each of the forming roll segments 30 relative to the lower forming roller 14 in the nip direction, and as is readily apparent, allow for each of the forming roll segments 30 to be so positively located independently of the other of the forming roll segments 30.

As shown in FIGS. 1 and 2, the pressure roller assembly 16 is designed in a fashion similar to the upper forming roller assembly 12, and in this regard includes a series of individual smooth surfaced pressure roll segments 80 which are located at individual stations spaced along the length of the lower forming roller 14. Each of the individual pressure roll segments 80 is supported by bearings for rotation about a stepped idler shaft 82 of a design similar to that of idler shafts 37, so that each of the shafts 82 defines a discrete pressure segment axis 84 about which each of the pressure roll segments 80 rotates. The pressure roll segments 80 are fixed laterally along their respective idler shafts 82 by cover plates similar to cover plates 42 and 44, and each pressure roll segment 80 and its associated components is supported between a pair of thin high strength steel supporting plates 86 which are in turn secured to individual spaced swing frames 88 by fasteners 89.

Each of the spaced swing frames 88 is formed with an integral pivot arm 90 having an elongated transversely extending aperture 92 formed along its length. A pivot shaft 94 and bearing 95 are received through each of the apertures 92 in pivot arms 90, with the shaft 94 being supported at its opposite ends, or intermediately if desired, by a shaft housing (not shown) to define a pivot axis 96 extending substantially parallel to the roller axis 15 of the lower forming roller 14. Each of the pivot arms 90 is also formed with a laterally depending flange 98 having a threaded through aperture for receiving a set screw assembly 100 operative to engage bearing 95 located on pivot shaft 94. Threaded bores 102 extending through the exposed ends 104 of pivot arms 90 are also provided for receiving second set screw assemblies 106 for engaging bearing 95 on pivot shaft 94 in the manner shown in FIG. 1. In this manner, each of the pivot arms 90 can be fixed for pivotal movement with pivot shaft 94 with the segment axis 84 of each pressure roll segment 80 fixed at a predetermined radial distance from pivot axis 96. As is readily apparent, the distance between each individual pressure segment axis 84 and pivot axis 96, and thus the location of each segment axis 84 relative to roller axis 15, can be varied and set as desired by suitable adjustment of the set screw assemblies 100 and 106 in the manner previously described.

As shown in FIGS. 1 and 2, the pressure roller assembly 16 is also provided with a series of adjustable mechanical stops 108 at spaced locations along a machine supporting frame 110 for operatively engaging the upper surface 112 of each of the pivot arms 90 to positively locate the individual pressure roll segments 80 in the nip direction relative to the lower forming roller 14. The individual mechanical stops 108 can be adjusted as desired for varying the positive location of each of the pressure roll segments 80 independently of the other pressure roll segments 80 along the length of the lower forming roller 14.

As so designed, the corrugating machine 10 provides the user with a machine having clearly improved operating features relative to prior single facer corrugating machines. In this regard, the individual discrete forming roll segments 30 of the upper forming roller assembly 12 cooperatively function like a single elongated upper forming roller utilized in prior machines, and thus cooperate with the lower forming roller 14 to form flutes in a medium 22 passed between the forming roller assembly 12 and the lower forming roller 14 in a conventional manner. However, with the design of the present invention, each of the forming roll segments 30 can be individually nip loaded as desired through distinct biasing means 18 for varying and optimizing nip loading of the paper medium 22 across its width. Moreover, since the nip load presented to or placed upon each forming roll segment 30 can be varied individually for each such roll segment 30, nip loading patterns can be varied as desired with paper media of varying widths and thicknesses. Furthermore, particular nip pressures may be reduced, or roll segments pulled back from contact adjacent the end of the lower forming roller 14 when the machine is run with paper having narrow widths. The same principles apply to the design of the pressure roller assembly 16, since each of the pressure roll segments 80 can be individually nip loaded against the lower forming roller 14, with the nip load applied to each individual pressure roll segment 80 by its individual biasing means 20 capable of being set and varied as desired independently of the nip loads applied to the other of the pressure roll segments 80. As is readily apparent, additional advantages resulting from the design of the machine 10 include the fact that the individual roll segments 30 and 80 can be supported on bearing systems which are substantially smaller in capacity than the bearings utilized in conventional single facer machines. Moreover, since each roll segment 30 and/or 80 is relatively short compared to the length of the rollers in conventional machines, design problems relating to thermal expansion of conventional elongated rollers are minimized. In addition to the above, it should be noted that each of the individual roll segments 30 and 80 can be constructed from a series of sleeves (not shown) assembled by suitable means to a mandrel to form an overall roll segment, so that flute formation geometries can be changed as desired.

Another advantage of the present invention is the ability of each of the roll segments 30 and 80 to be adjusted in angular position relative to the lower forming roller 14. The invention thus allows the operator to specifically address and reduce noise and vibration associated with interactions between the forming roll flutes, as well as between the lower forming roller 14 and the pressure roller assembly 16. More particularly, the design of each of the roll segments 30 and 80 and their associated pivotal support assemblies enables the individual discrete segment axes 40 and 84 of each roll segment 30 and 80 to be moveable relative to their associated pivot axes 60 and 96, so that the nip centerline formed between each roll segment 30 and/or 80 can be positioned as desired relative to the lower forming roller 14 and its roller axis 15. This feature of the invention is illustrated most readily in FIG. 2, which shows individual forming roll segments 30 and pressure roll segments 80 positioned at varying angular locations relative to the lower forming roller 14. Thus, the overall noise and vibration associated with the machine 10 is significantly less than conventional single facer machines because the individual roll segments 30 and 80 can be position adjusted so that the interaction of each particular roll segment with the lower forming roller 14 will occur at a slightly different angular location relative to the lower forming roller 14, and the corrugating and pressure roll forces will be out-of-phase across the width of the machine 10 and the medium 22. A further advantage of the overall design of the machine 10 over present corrugating machines stems from the fact that the overall phase relationship of the impact pattern between the upper forming roll segments 30, as well as the impacts of the pressure roll segments 80, with the lower forming roller 14 can be adjusted to allow for overall "tuning" of the machine 10 to minimize overall noise and vibration. The machine can then be "dephased" across the width of the machine and also in the machine direction.

Figure 4:
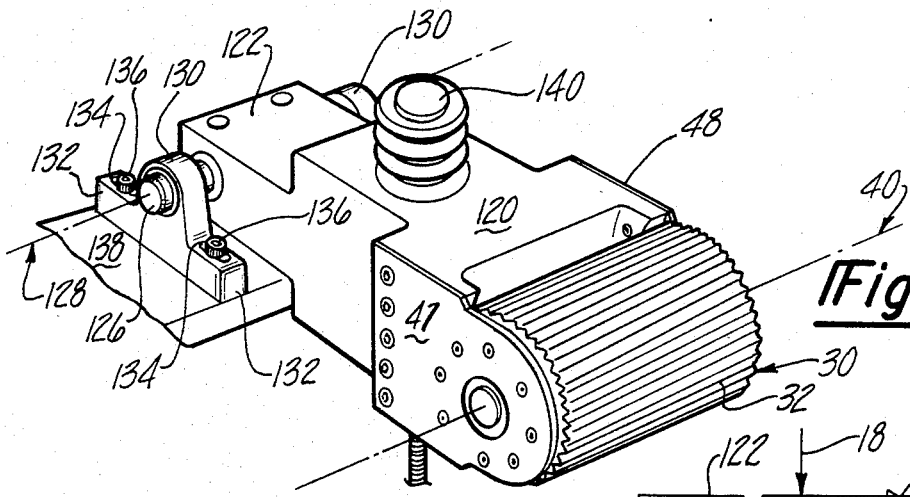
FIG. 4 is a partial perspective view of another embodiment of the present invention.

FIG. 4 illustrates a second embodiment of the present invention having an alternate means for controlling the angular location of the individual roll segments 30 and 80 relative to the lower forming roller 14. In this connection, FIG. 4 shows an exemplary forming roll segment 30 supported for rotation about a roll segment axis 40 between support plates 47 and 48 and which are fastened to a modified swing frame structure 120 having a depending pivot arm 122 journaled for pivotal movement about a pivot stub shaft 126 defining a pivot axis 128. The stub shaft 126 is journaled for pivotal movement between a pair of spaced supporting blocks 130 formed with opposed depending legs 132 having elongated slots 134 for receiving locating bolts 136 to slide mount the supporting blocks 130 to an associated supporting frame 138. FIG. 4 also illustrates an air mount system 140 for generating nip pressure against the swing frame 120 for nip loading the roll segment 30 against the lower forming roller 14.

In the embodiment of the invention illustrated in FIG. 4, the segment axis 40 about which the forming roll segment 30 is supported for rotation remains at a fixed radial distance from the pivot axis 128. However, because of the provision of the elongated slots 134 in supporting blocks 130, the location of both axes 40 and 128 can be varied relative to the lower roller axis 15, and thus the angular location of the forming roll segment 30 can likewise be varied relative to the lower forming roller 14, by suitable position adjustment of the supporting blocks 130 relative to the supporting frame 138. Moreover, since each of the forming and pressure roll segments 30 and 80 can be provided with similar types of supporting assemblies, it is readily apparent that the angular location of individual forming roll segments 30 and/or pressure roll segments 80 can be adjusted independently of each other as desired for overall phase control of the corrugation forming process and liner application process. The principle of the invention is not limited to the particular adjustable positioning arrangement shown in FIG. 1, 2 or 4, but can be similarly accomplished by the use of eccentrics, linkages or other mechanical arrangements which can be adapted to provide for adjustment of the segment axes of the individual roll segments 30 and/or 80 relative to the lower forming roller 14.

Figure 5:
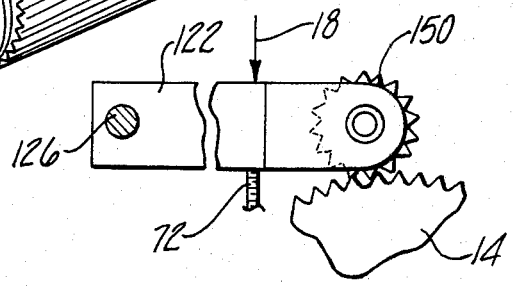
FIG. 5 is a schematic view of yet another embodiment of the present invention.

A further advantage associated with the design of the machine 10 is that it eliminates the need for large diameter rollers, so that the disadvantages of complex labyrinths and large flute tip radii are avoided. The forming roll segments 30 of the machine 10 may be of a substantially smaller diameter for easier flute forming. If smaller diameter forming roll segments are utilized, such as shown in FIG. 5 at 150, the roll flute form or profile may be designed with a smaller tip radius than conventional corrugating rollers. Such small diameter segments 150 yield more of a folding action, as opposed to the gathering/folding action and high tip sliding associated with conventional machine rollers. Moreover, the more pointed flute form of the roll segment 150 allows for flute shapes that are closer to the optimum shape for minimum medium take-up, and thus result in a substantial savings in medium expense.

The design of the present machine 10 also yields expanded life spans for the corrugating and pressure roll components of the system because the functional effect of roll wear can be minimized. More particularly, in conventional systems, the medium can no longer function effectively when corrugating and/or pressure rolls exhibit a threshold loss of crown shape due to wear, because flute forming and liner attachment require the geometry, spacing, and nip pressure of the rolls relative to one another to be maintained to within relatively close tolerances across the width of the machine. The design of the present invention, however, allows for this type of roll wear to be compensated for through simple position adjustment of particular roll segments across the width of machine 10 such as by adjustment of stop assemblies 72 and 108, or adjustment of nip pressure through individual biasing means 18 and 20.

The design of the machine 10 yields further advantages over prior conventional single facer machines since it presents a machine design which can more readily accommodate the passage of foreign objects such as tools which could otherwise damage the rolls. In this regard, if a foreign object passes through the nip centerline under a particular roll segment, the overall force necessary to open the nip between that roll segment and the lower forming roller 14 to allow the foreign object to pass through is much lower than that associated with existing elongated roller designs. This is because each particular roll segment is loaded individually in the present invention. Moreover, each roll segment and its associated supporting structure is much lighter in weight than conventional roller assemblies, so that inertial forces which resist nip opening are substantially reduced. A further advantage over present machine designs relates to the fact that the segmented nature of the upper forming roller assembly 12 and the pressure roller assembly 16 requires only a particular roll segment to be replaced upon a damage event. The design of the machine 10 thus possesses a distinct advantage over prior machine systems, which often require the replacement of an entire elongated roller when a particular zone along its width is damaged.

In conjunction with the above, it should be noted that the mechanical supporting arrangements for the individual roll segments 30 and 80 can also be designed with a release means so that nip opening forces which exceed a predetermined value, or foreign object dimensions which exceed a predetermined threshold dimension, will achieve a substantially instantaneous movement of the roll segment away from the lower forming roller 14 to allow the foreign object to pass through the system. Such a release means can be achieved by utilizing a shear pin or functionally similar mechanism in the roll segment supporting or positioning structures which will fail almost instantaneously in the event of such a foreign object passing through the nip centerline, enabling the roll segment to swing clear to minimize any roll damage.

Another advantage of the design of the machine 10 stems from the fact that individual roll segments may be adjusted and positively located by way of the mechanical stops 72 and 108. It is particularly desirable to so adjust the pressure roller of a single facer system to such a mechanical stop rather that to load it against the lower corrugating roller. However, such positive location is difficult, if not impossible, with prior known single facer machines since the rollers in such systems have an unpredictable shape due to variations in operating conditions and wear. High vibration levels also make adjustment a problem. The result is that it is very difficult to adjust the pressure roller so that it just "kisses" the lower corrugating roller. However, the reduced vibration characteristics of the machine 10 resulting from dephasing of the flute forming action in the medium 22 facilitate adjustment to the disclosed mechanical stops 72 and 108. Moreover, with the design of the present machine 10, such mechanical stop adjustment is more possible because the mechanical stops 108 for the discrete pressure roll segments 80 can be individually adjusted to match the deflected and worn shape of the lower forming roller 14.

A further feature of the invention is that the reduced vibration characteristics and individual phasing features of the invention enable optional replacement of the biasing means 18 and 20 with mechanical stop type assemblies similar to those shown at 72 and 108, so that the individual roll segments 30 and 80 may be adjusted and positively located to a specific clearance dimension relative to lower forming roller 14, rather than being pressure or nip loaded against roller 14. This feature yields simplifications in machine design an overall machine operation. Moreover, it eliminates the necessity for an operator to adjust machine settings when running a narrow width of paper medium, since the segments in which the paper medium does not run will automatically define clearance locations. This feature also contributes to further reduction in noise and vibration, particularly in the case of the pressure roller assembly 16 because the individual pressure roll segments 80 will not follow the hill and valley character of the lower forming roller 14, but will rather maintain position and contact the lower forming roller 14 only when the flute tips of the roller 14 are in their respective nip positions. As is readily apparent, such a dimensional system, as opposed to a nip loading or "force" system, facilitates the use of a shear pin or similar functional device in the positioning arrangements which will fail in the event of a foreign object passing though a particular nip centerline. Such failure will permit an individual roll segment to swing clear and minimize any roll damage otherwise associated with the passage of the foreign object through such a nip centerline.

In each of the above-described embodiments of the invention, when the individual forming roll segments 30 are displaced in phase, flute formation across the width of the medium 22 will not be simultaneous, but will occur progressively across the width of the medium 22 in discrete segments in a formation pattern determined by the phase relationship of the individual forming roll segments 30. The flutes formed in the medium 22 will be linear or straight flutes extending in the direction of the width of the medium 22. However, the dephasing feature of the invention allows flutes to be formed in discrete linear segments in a non-simultaneous fashion across the width of the machine 10 and the medium 22. It should be noted that a small gap such as shown at 142 in FIG. 3 will exist between the associated supporting assemblies of each roll segment 30 and 80. However, this gap 142 does not have a major effect on flute formation because the characteristics of the medium 22 allow the paper to bridge the gap areas across the width of the medium 22.

It should be pointed out that dephasing of the forming roll segments 30 will result in a slight stretching of the medium 22 between individual segments 30. However, the overall amount of stretching created in the medium 22 is well within the elasticity of the medium 22 and can be readily tolerated thereby. In this regard, the typical tip-to-tip spacing of commonly used flutes is in the range of one quarter inch to five sixteenths inches, so that dephasing across the width of the medium 22 requires a relatively small overall circumferential displacement of the roll segments 30 and 80 relative to the lower forming roller 14, and an even smaller displacement of adjacent roll segments relative to one another.

Figure 6:
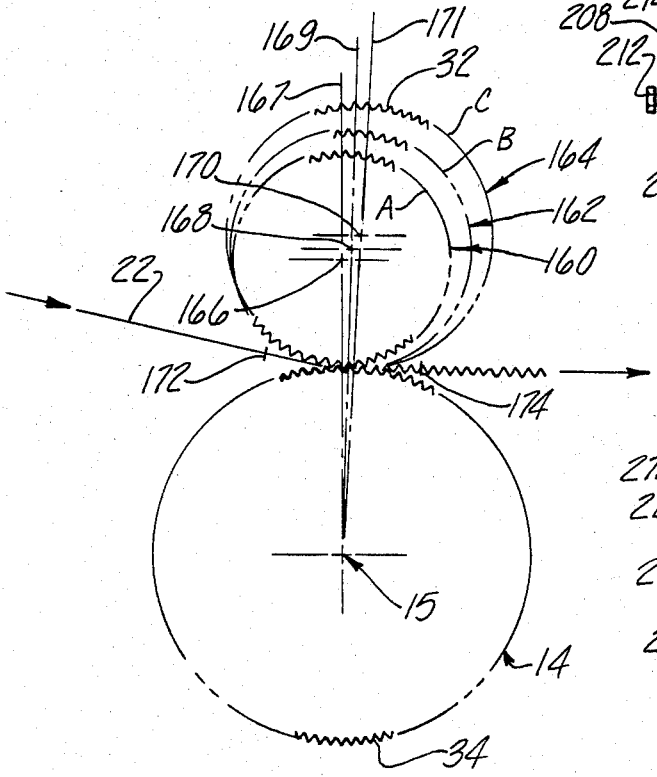
FIG. 6 is a schematic view illustrating a further embodiment of the invention.

If, however, it is desirable to reduce stretching of the medium 22 to a minimum, it is possible to adjust the diameter of individual forming roll segments 30 so that the difference in phase relationship between individual segments 30 is largely compensated for by differences in the diameters of the roll segments 30. Such an embodiment of the invention is illustrated in schematic form in FIG. 6, which shows a lower forming roller 14 defining a roller axis 15 and a series of dephased forming roll segments 160, 162 and 164 having diameters A, B and C, respectively. Roll segment 160 defines a segment axis 166 and a nip centerline 167 extending between segment axis 166 and roller axis 15. Roll segment 162 likewise defines a segment axis 168 and a different discrete nip centerline 169 extending through axis 168 and roller axis 15. Similarly, forming roll segment 164 defines a segment axis 170 and a nip centerline 171 which extends through the two axes 170 and 15. Each of the respective roll segments 160 through 164 is operative to engage the paper medium 22 as it passes between a medium entry location 172 and an exit location 174, and cooperates with the lower forming roller 14 to define a maximum medium impact point along its respective nip centerline between the entry location 172 and exit location 174. However, as FIG. 6 illustrates, the maximum impact points of roll segments 160 through 164 are displaced in phase along their respective centerlines 167, 169 and 171. Yet, by providing the respective roll segments 160 through 164 with different diameters A through C, the arc of travel of each respective segment 160 through 164 is made more similar in the general area of the entry location 172, so that the onset and rate of flute formation in the medium 22 is more similar across the width of the medium 22 and medium stretching across its width is reduced. As is readily apparent, the above-described principles can be equally applied to the pressure roll segments 80.

In some medium applications, it is necessary to provide heat energy to the medium and/or the liner. The design of the present invention is adaptable to such applications so that additional heated rollers may be located to heat the medium or liner prior to entry into the flute forming nip centerlines and/or pressure roll centerlines. Alternatively, such heat energy can be supplied by electrical radiation or induction heaters applied to individual roll segments, and the present invention enables the application of heat to be controlled from segment to segment if desired. This feature enables medium warping to be reduced through the selective application of heat to appropriate roll segments.

Figure 8:
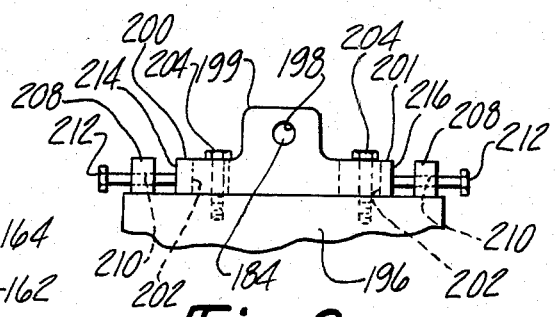
FIG. 8 is a partial cross-sectional view taken in the direction of Line 8—8 of FIG. 7.
Figure 9:
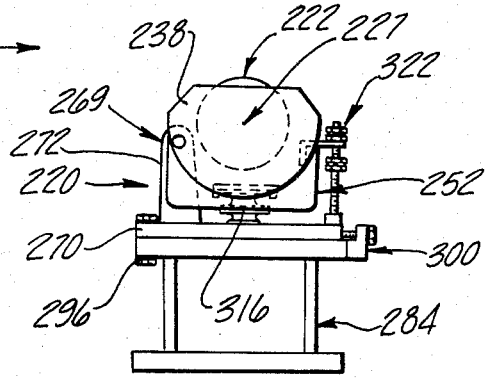
FIG. 9 is a schematic side view of yet another embodiment of the invention.
Figure 7:
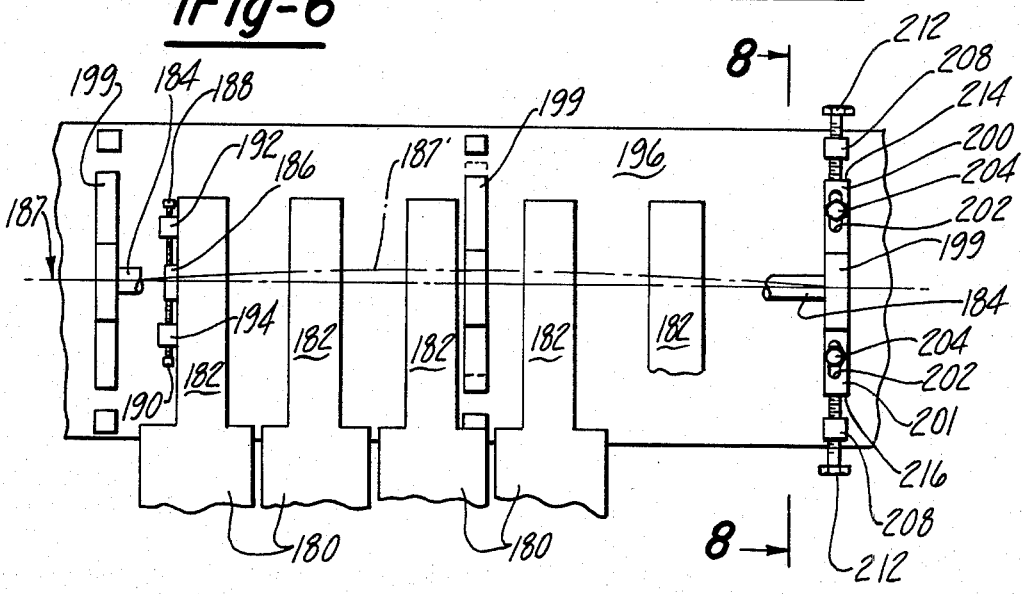
FIG. 7 is a schematic view of a further embodiment of the invention.

Another embodiment of the present invention is illustrated in schematic form in FIGS. 7 and 8. This embodiment includes a plurality of swing frames 180 respectively operative to support individually spaced forming roll segments and/or pressure roll segments. Each of the swing frames 180 is formed with a depending elongated pivot arm 182 having an elongated slot (not shown) through which a single pivot shaft 184 and bearing 186 are passed for supporting the swing frames 180 and their associated roll segments for pivotal movement. The pivot shaft 184 is supported at its opposite ends in shaft housings (not shown) to define a pivot axis 187 about which each swing frame 180 and its associated roll segment is supported for pivotal movement. Each of the swing frames 180 is provided with opposed set screws 188 and 190 extending through depending flanges 192 and 194 on pivot arms 182, and which are operative to engage bearing 186 to secure the swing frame 180 for pivotal movement with shaft 184 about pivot axis 187. The set screws 188 and 190 may be adjusted as desired to vary the position of each swing frame 180 and its associated roll segment relative to pivot axis 187, as well as with respect to the roller axis of the lower forming roller (not shown).

The embodiment of the invention illustrated in FIG. 7 is thus similar to the previously described embodiments in that the above-described features allow for individual phase adjustment of roll segments for reducing vibration and noise during corrugation formation and/or liner application. However, the present embodiment of the invention includes the further feature of family or "gang" type phase adjustment. In this regard, pivot shaft 184 is supported above a machine frame 196 within bores 198 of spaced slide block assemblies 199 in the manner shown in FIG. 7. Each individual slide block assembly 199 is formed with a pair of opposed depending legs 200 and 201, each of which has an elongated aperture 202 through which clamping bolts 204 are passed into the machine frame 196 for fixing the position of the slide block assembly 199. The machine frame 196 is formed with spaced upwardly projecting blocks 208 formed with threaded apertures 210 through which are received opposed adjustable set screws 212. Set screws 212 are operative to engage the opposed faces 214 and 216 of legs 200 and 201 in the manner shown in FIGS. 7 and 8, and may be turned and backed off as desired to apply a lateral force to pivot shaft 184. The design of the individual slide block assemblies 199 enables the operator to variably position each slide block assembly 199 independently of the other slide block assemblies 199, and further allows the operator to place a bending moment upon pivot shaft 184 and flex the shaft 184 along its length. Such flexing enables the operator to effectively dephase the family of roll segments at one time across the width of the machine frame 196. An example of such dephasing is illustrated in FIG. 7, wherein the middle slide block assembly 199 has been displaced laterally along machine frame 196 relative to the adjacent slide block assemblies 199 so that pivot shaft 184 defines a pivot axis as shown at 187'. Since the overall displacements of individual roll segments necessary to achieve effective dephasing across the width of the machine is small, the required flexing of shaft 184 is well within the elastic range of the material of shaft 184.

Another embodiment of the invention illustrating further features thereof is shown in FIGS. 9 through 13. This embodiment includes a plurality of forming roll subassemblies 220. Each such subassembly 220 includes a forming roll segment 222 formed with a plurality of longitudinally extending flutes 224 about its periphery. Since each subassembly 220 is identical in nature, only one will be described hereafter. Forming roll segment 222 is supported by bearings 225 about an idler shaft 226 which defines a roll segment axis 227 about which the roll segment 222 rotates. The subassembly 220 is also provided with annular seals 230 on the outboard side of each bearing 225 as well as with fixing rings 232 which are threaded upon the opposed ends 234 of shaft 226 in the manner shown in FIG. 11 to fix the roll segment 222 for rotation on shaft 226.

Figure 10:
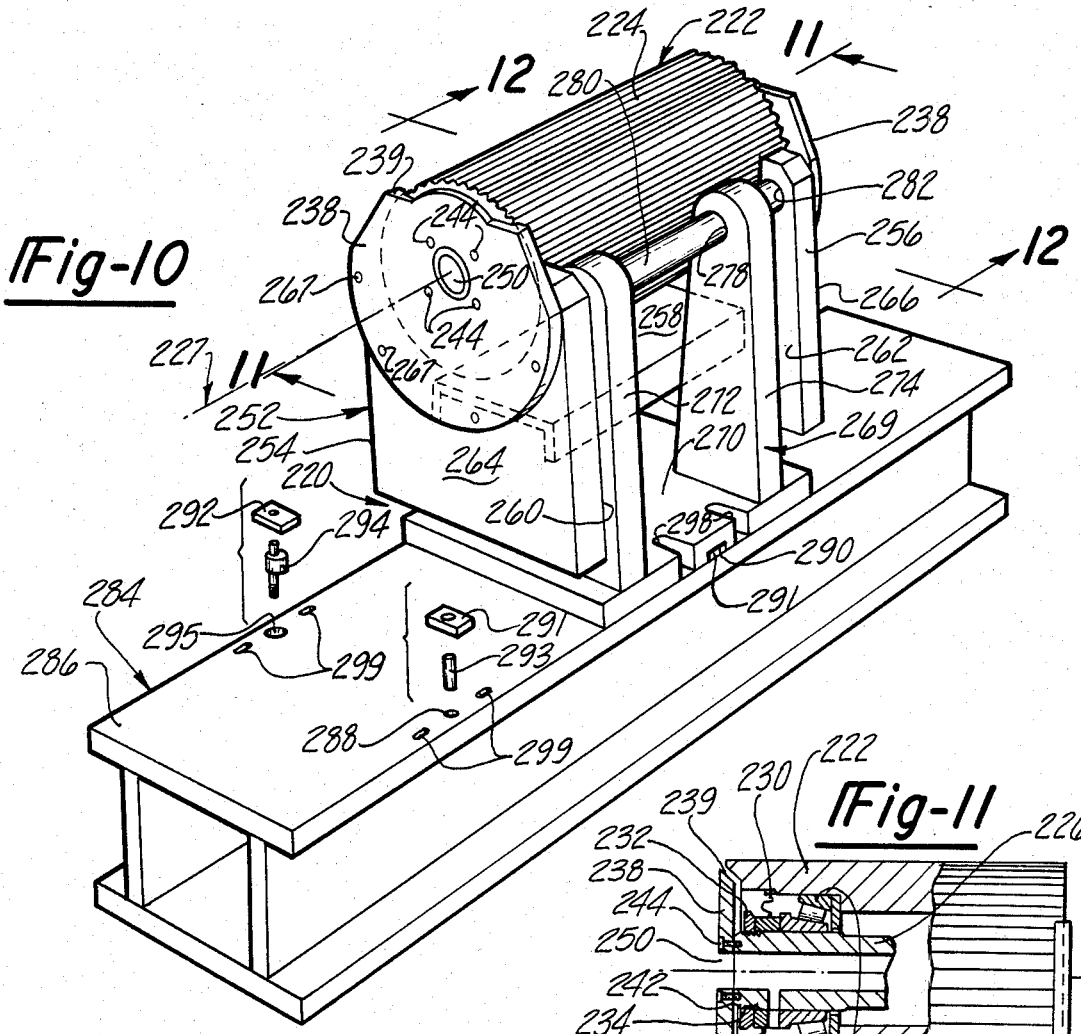
FIG. 10 is a partial perspective view of the embodiment of the invention shown in FIG. 9.
Figure 11:
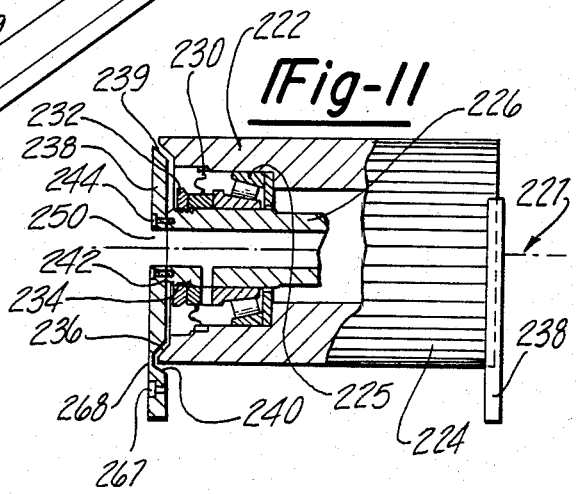
FIG. 11 is a partial cross-sectional view taken in the direction of Line 11—11 of FIG. 10.

Forming roll segment 222 is further formed with beveled ends 236 which facilitate the utilization of support plates 238 as shown in FIGS. 10 and 11 to minimize the gap between individual forming roll segments 222. In this regard, each of the support plates 238 is formed with a beveled annular end 239 which is received within a beveled end 236 of roll segment 222 in the manner shown in FIG. 11. In addition, each support plate 238 is formed with an annular groove or track 240 within which the radially outer periphery of each roll segment end 236 is received. The support plates 238 are dimensioned to enable them to be rigidly secured to the end faces 242 of shaft 226 by way of fasteners 244. As shown most readily in FIG. 11, each of the support plates 238 is also formed with a through aperture 250 which communicates with the interior of idler shaft 226 to facilitate lubrication of each individual shaft 226 and roll segment 222.

Each of the subassemblies 220 further includes a swing frame 252 formed from a pair of parallel end plates 254 and 256 and a rigid load bearing plate 258 which extends normally between the opposed inner faces 260 and 262 of end plates 254 and 256, respectively. As shown in FIG. 10, end plates 254 and 256 also define opposed outer faces 264 and 266 to which the support plates 238 are secured by way of fasteners 267. The overall design of each subassembly 220, and particularly, of each roll segment 222 and its associated shaft 226 and support plates 238, provides a rigid structural design, and at the same time enables the gap between adjacent forming roll segments 222 to be kept to a minimum dimension. In this regard, it should be noted that the provision of annular grooves 240 in each of the support plates 238 results in each support plate 238 having a relatively thin annular section 268 which defines the weakest structural location of the plate 238. However, since each support plate 238 is rigidly secured to an end face 242 of shaft 226, the rigidity of shaft 226 is tied to the support plates 238 to yield a structurally rigid dumbbell configuration on one side of section 268. On the other hand, since the support plates 238 are rigidly secured on the other side of sections 268 to end plates 254 and 256, which in turn are fixed to opposite ends of the rigid load bearing plate 258, the overall structural configuration of the subassembly 220 possesses sufficient rigidity so that the possibility of flexing support plates 238 about section 268 is reduced to a minimum. The subassembly 220 further includes a supporting frame structure 269 which is comprised of a base plate 270 and a pair of spaced parallel upwardly depending support arms 272 and 274 formed with aligned bores 278 through which is received a pivot shaft 280. As shown in FIG. 10, the opposite ends of pivot shaft 280 are received and secured within aligned bores 282 in end plates 254 and 256 so that the swing frame 252 and roll segment 222 are operative to pivot as a unit about the axis of pivot shaft 280.

Figure 13:
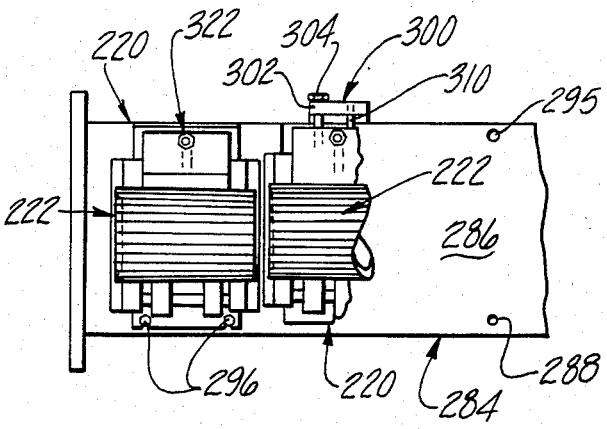
FIG. 13 is a partial top view of the embodiment of the invention shown in FIG. 9.

As shown in FIGS. 10, 12 and 13, each of the above-described subassemblies 220 is carried upon a structural box beam 284 extending across the width of the machine, and is individually positionable along the top member 286 thereof to allow independent alignment and positioning of each subassembly 220 for effecting phase adjustment and overall dephasing of the roll segments 222 across the width of the machine. In this regard, the box beam 284 is formed with a plurality of spaced pivot holes 288 in top member 286. On the other hand, the base plate 270 of each subassembly 220 includes a rectangular slot 290 formed on its undersurface. The base plate 270 is positioned above top member 286 with the slot 290 defining a rectangular channel for receipt of keys 291 and 292 to locate each subassembly 220. The individual keys 291 and 292 are secured in the slot 290 within base plate 270 by way of a pivot pin 293 operative to be received within pivot hole 288 and an eccentric pivot pin 294 received within a complimentary shaped stepped bore 295 in top member 286 such as shown in FIGS. 10 and 12. The keys 291 and 292 are operative to restrain subassembly 220 against longitudinal movement along box beam 284. On the other hand, the above keyway design enables each subassembly 220 to be positioned laterally along the box beam 284 as desired for phase adjustment of individual roll segments 222, as well as aligned for parallelism with the lower corrugating roll by adjustment of the eccentric pivot pin 294. To secure each individual subassembly 220 at a desired location laterally along box beam 284, bolts 296 are passed through a pair of spaced elongated slots 298 in base plate 270 and apertures 299 in top member 286 of the box beam 284. Lateral position or phase adjustment of each subassembly 220 is made possible by way of a push/pull adjustment mechanism 300 shown most readily in FIG. 12. The mechanism 300 includes a block 302 and screw 304, which is passed through hole 306 in block 302 and received within a threaded bore 308 in the top member 286 of box beam 284. A set screw 310 is provided within a threaded aperture 312 in block 302 and is operative to engage the side face 314 of base plate 270 in the manner shown in FIG. 12. A bolt (not shown) passes through a clearance hole in block 302 and is threadably engaged to the side face 315 of top member 286. Adjustment of screw 310 and the bolt engaged in side face 315 of member 286 enables the operator to manually adjust the lateral positioning of each subassembly 220 as desired. As shown most readily in FIG. 12, this embodiment of the invention is also provided with an airbag device 316 for generating a biasing force against swing frame 252 to nip load its associated forming roll segment 222 against the lower forming roller. In this regard, the airbag 316 is positioned between the top surface 318 of base plate 270 and the undersurface 320 of the load bearing plate 258 to bias the swing frame in the direction of the arrow shown in FIG. 12.

The embodiment of the invention illustrated in FIG. 12 further includes mechanical stop systems 322 which enable the spacing and nip pressure of individual forming roll segments 222 relative to one another and to the lower forming roller to be maintained to within relatively close tolerances. Each mechanical stop system 322 includes an interference flange 324 which is welded at one end to the top surface 326 of the load bearing plate 258 of swing frame 252, and which defines a tongue portion 328 extending substantially parallel to plate 258. Tongue portion 328 is formed with an elongated aperture 330 through which an elongated stud 332 is passed. Stud 332 is threaded at one of its ends 334 so that it can be received within an internally threaded female base 336 welded to base plate 270. The opposite end 338 of stud 332 is provided with a limit nut-washer assembly 340 operative to engage the upper surface 342 of tongue portion 328 when the swing frame 252 and its associated forming roll segment 222 are biased a predetermined distance toward the lower forming roller, and the nut-washer assembly 340 can be positioned adjusted along the length of stud 322 to define an overall limit of movement of roll segment 222 toward the lower forming roller as desired. A second nut-washer assembly 344 can also be provided along the threaded end 338 of stud 332 for engagement with the undersurface 346 of tongue portion 328. Suitable positioning of each of the nut-washer assemblies 340 and 344 enables the operator to positively fix the location of each roll segment 222 and its associated roll segment axis 227 relative to the lower forming roller and its roller axis. As is readily apparent, the stop systems 322 enable individual forming roll segments 222 to be adjusted and positively located or fixed to a specific clearance dimension relative to the lower forming roller, rather than being pressure or nip loaded against the lower roller. This feature thus eliminates the necessity for an operator to adjust machine settings when running a narrow width of paper, since segments in which the paper does not run will automatically define clearance locations. This feature further contributes to a reduction in noise and vibration for the previously described reasons.

Figure 14:
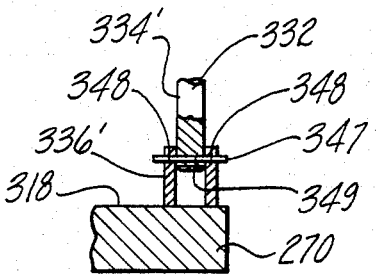
FIG. 14 is a partial cross-sectional view of yet another embodiment of the invention.

The dimensional system achieved with this embodiment of the invention also facilitates the use of a shear pin failure device in the event a foreign object passes between a particular nip center line. In this connection, attention is directed to FIG. 14, which illustrates a shear pin 347 assembled through apertures 348 in a female base 336′ and hole 349 in the end 344′ of stud 332. In the event a foreign object of a size greater than the preset clearance dimension passes through the nip center line of a roll segment having the shear pin mechanism illustrated in FIG. 14, the shear pin 347 will fail and permit its associated swing frame 252 and roll segment 222 to swing clear and minimize any roll damage otherwise associated with passage of the foreign object through the nip center line of that roll segment 222. While the above description has been directed to subassemblies 220 and its related components which cooperate to support individual forming roll segments 222, the above-described features are equally applicable to individual pressure roll segments, and the invention is intended to include such applications.

Each of the previously described embodiments of the invention possesses the feature of enabling phase adjustment of individual roll segments across the width of the corrugating machine. In contrast, FIGS. 15 and 16 illustrate another embodiment of the invention which enables the phasing of an entire forming roll segment assembly and/or pressure roll assembly to be adjusted as one unit in the direction of paper movement through the machine—i.e., in the machine direction. In this regard, FIGS. 15 and 16 illustrate a lower forming roller 350 defining a roller axis 352 and supported at its opposite ends in a support frame 354. This embodiment of the invention further includes a pivot frame 356 which is defined by a pair of end plates 358 and 360 secured together by way of clamping bolts 362 for pivotal movement about a cylindrical shank 364 depending from support frame 354 and having a pivotal axis which is coaxial with roller axis 352. Two such pivot frames 356 support the previously described box beam 284 between them, along with a series of the previously described forming roll subassemblies 220 at individual locations spaced along the length of the lower forming roller 350. Each of the pivot frames 356 is further formed within arcuate slot 368 operative to receive a clamping bolt 370, which is in turn received within a threaded bore 372 in the support frame 354. These features of the present embodiment enable the entire combination of pivot frames 356, box beam 284 and subassemblies 220 to be pivoted about roller axis 352 as desired to optimize corrugation forming and/or liner application geometries in particular applications. Positioning and repositioning of the above assembly about the roller axis 352 can be achieved by loosening clamping bolts 370, pivoting the assembly to a desired angular location, and retightening the clamping bolts 370.

The above description is that of the preferred embodiments of the invention and various changes and modifications may be made thereto without departing from the spirit and scope of the invention as defined in the appended claims.

What is claimed is:

1. A corrugating machine comprising a first corrugating roller assembly having a series of spaced corrugating segments which are nip loaded against and cooperative with a second corrugating roller assembly for forming corrugations across the width of a paper medium as it passes between said first and second corrugating roller assemblies, and means for individually nip loading each of said corrugating segments which enables nip loads to be generated and varied in independent discrete segments spaced across the width of said medium.

2. A corrugating machine comprising a corrugating roller assembly for forming corrugations in a paper medium, a segmented pressure roller assembly which is nip loaded toward and cooperates with said corrugating roller assembly to facilitate application of a liner to said corrugated medium as it passes between said corrugating roller assembly and said pressure roller assembly, and means for controlling nip loading of said segmented pressure roller assembly which enables nip loads to be generated and varied in independent discrete segments spaced across the width of said corrugated medium.

3. A corrugating machine for forming corrugations across the width of a paper medium and applying a liner to the corrugated medium to yield a single faced corrugated paper product comprising a first forming roller assembly cooperative with a second forming roller assembly for forming corrugations in said medium, a pressure roller assembly which is loaded through a nip centerline against one of said forming roller assemblies to facilitate the application of said liner to said corrugated medium, and phase control means which enables the timing of corrugation formation in said medium to be set and varied as desired across the width of said medium and the angular location of said nip centerline of said pressure roller assembly relative to said one forming roller assembly to be set and varied as desired along the length of said one forming roller assembly.

4. A corrugating machine for forming corrugations across the width of a paper medium and applying a liner to the corrugated medium to yield a single faced corrugated paper product comprising a first corrugating roller assembly cooperative with a second corrugating roller assembly for forming substantially straight corrugations in the medium as it passes between said first and second corrugating roller assemblies, a pressure roller assembly cooperative with one of said corrugating roller assemblies to apply the liner to the corrugated medium as it passes between said one corrugating roller assembly and said pressure roller assembly, and means for controlling corrugation formation in said medium which enables substantially straight corrugations to be formed in discrete segments in a non-simultaneous fashion across the width of said medium.

5. A corrugating machine as set forth in claim 4 wherein the corrugations of each discrete segment are aligned with the corrugations of the adjacent discrete segments along the width of said medium.

6. A corrugating machine as set forth in claim 4 wherein said controlling means enables the timing of corrugation formation within each of said discrete segments to be varied independently of the timing of corrugation formation within the other of said discrete segments.

7. A corrugating machine as set forth in claim 4 further comprising positioning means which enables the nip centerline between said pressure roller assembly and said one corrugating roller assembly to be defined in discrete segments along the width of said medium, with the position of each discrete segment of nip centerline being moveable relative to said one corrugating roller assembly independently of the position of the other of said discrete segments of nip centerline.

8. A corrugating machine for forming corrugations in a paper medium for making a corrugated paper product comprising an elongated fluted roller defining a roller axis and supported at its opposite ends for rotation about said roller axis, a plurality of forming roll segments, with each of said forming roll segments defining a segment axis spaced from said roller axis and having flutes which cooperate with said fluted roller to form corrugations in a paper medium passed between said fluted roller and said forming roll segment, and means for supporting each of said forming roll segments for rotation about its respective segment axis and at a location disposed between the opposite ends of said fluted roller.

9. A corrugating machine as set forth in claim 8 wherein said supporting means supports each of said forming roll segments at an individual location along the length of said fluted roller.

10. A corrugating machine as set forth in claim 8 wherein the segment axis of each of said forming roll segments extends in a direction substantially parallel to said roller axis.

11. A corrugating machine as set forth in claim 8 wherein said supporting means includes means for adjusting the location of the segment axis of each of said forming roll segments relative to said roller axis.

12. A corrugating machine as set forth in claim 8 further comprising means for biasing each of said forming roll segments in the direction of said fluted roller for nip loading each of said forming roll segments against said fluted roller.

13. A corrugating machine as set forth in claim 12 wherein the nip load applied to each individual forming roll segment by said biasing means can be varied independently of the nip load applied to other of said forming roll segments.

14. A corrugating machine as set forth in claim 8 wherein said supporting means further supports each of said forming roll segments for pivotal movement about a pivot axis with the segment axis of each said forming roll segment spaced at a radial distance from said pivot axis.

15. A corrugating machine as set forth in claim 14 wherein said pivot axis extends substantially parallel to said roller axis, and each of said segment axes extends substantially parallel to said pivot axis.

16. A corrugating machine as set forth in claim 14 wherein said supporting means further includes means for adjusting the radial distance between said segment axes and said pivot axis.

17. A corrugating machine as set forth in claim 14 wherein said supporting means further includes adjusting means which allows the segment axis of each individual forming roll segment to be located radially relative to said pivot axis independently of the segment axes of the other of said forming roll segments.

18. A corrugating machine as set forth in claim 8 wherein said supporting means further supports each of said forming roll segments for pivotal movement about its own distinct pivot axis spaced from said roller axis.

19. A corrugating machine as set forth in claim 18 wherein each of said distinct pivot axes extends in a direction substantially parallel to said roller axis.

20. A corrugating machine as set forth in claim 18 wherein said supporting means further includes adjustment means for varying the distance between each of said distinct pivot axes and said roller axis as desired.

21. A corrugating machine as set forth in claim 20 wherein said adjustment means enables the distance between the distinct pivot axis of each individual forming roll segment and said roller axis to be changed independently of the distance between the pivot axes of the other of said forming roll segments and said roller axis.

22. A corrugating machine as set forth in claim 8 further comprising means for fixing the location of each of said forming roll segments in the direction of the nip centerline of that forming roll segment relative to said fluted roller.

23. A corrugating machine as set forth in claim 22 wherein said fixing means comprises a series of mechanical stops which engage said supporting means to positively locate each of said forming roll segments relative to said fluted roller.

24. A corrugating machine as set forth in claim 22 wherein said fixing means enables each of said forming roll segments to be located relative to said fluted roller independently of the other of said forming roll segments.

25. A corrugating machine as set forth in claim 22 wherein said fixing means enables the distance between the segment axis of each of said forming roll segments and said roller axis to be adjusted as desired independently of the distance between the segment axes of the other of said forming roll segments and said roller axis.

26. A corrugating machine as set forth in claim 8 further comprising means for fixing the location of said forming roll segments a predetermined clearance distance from said fluted roller but which allows said forming roll segments to move from said clearance distance and away from said fluted roller to accommodate passage of a foreign object with a dimension greater than said clearance distance between said fluted roller and said forming roll segments.

27. A corrugating machine as set forth in claim 26 wherein said fixing means enables any one of said forming roll segments to move from said clearance distance independently of the other of said forming roll segments.

28. A corrugating machine as set forth in claim 26 wherein said fixing means includes a shear pin component operative to fail to facilitate movement of said forming roll segments from said clearance distance if said foreign object generates a nip force exceeding a predetermined threshold value.

29. A corrugating machine as set forth in claim 8 wherein said forming roll segments cooperate with said fluted roller to form linear flutes in discrete sections of said paper medium extending in the direction of the width of said medium.

30. A corrugating machine as set forth in claim 8 wherein said supporting means comprises distinct swing frame structures for supporting each of said forming roll segments for rotation about its respective segment axis, with each said forming roll segment and its associated swing frame being independently positionable relative to said roller axis as a separate subassembly.

31. A corrugating machine as set forth in claim 8 wherein said supporting means comprises distinct swing frame structures supported for pivotal movement at separate locations along the length of a pivot shaft spaced from said roller axis, with each of said swing frames supporting a single forming roll segment for rotation about its respective segment axis and for pivotal movement about said pivot shaft.

32. A corrugating machine as set forth in claim 31 further comprising means for flexing said pivot shaft along its length for simultaneously varying the location of each swing frame and its associated forming roll segment relative to said roller axis.

33. A corrugating machine as set forth in claim 8 wherein the supporting means for each said forming roll segment comprises an idler shaft which individually supports said forming roll segment for rotation about its segment axis, spaced parallel support plates rigidly attached to the opposite ends of said idler shaft adjacent the opposite ends of said forming roll segment, and a supporting structure to which each said supporting plate is rigidly secured.

34. A corrugating machine as set forth in claim 33 wherein the length of said idler shaft is less than the length of said forming roll segment, and the opposite ends of said forming roll segment are relieved radially inwardly of its outer peripheral surface to define recesses within which said support plates are received for attachment to the opposite ends of said idler shaft.

35. A corrugating machine as set forth in claim 34 wherein the radially outer periphery of each end of said forming roll segment is operative to be received within and move through an annular recess formed within the adjacent support plate as said forming roll segment rotates about its segment axis.

36. A corrugating machine as set forth in claim 35 wherein the annular recess of each said support plate is disposed radially between the point at which the support plate is rigidly attached to said idler shaft and the point at which the support plate is rigidly secured to said supporting structure.

37. A corrugating machine for forming a corrugated paper medium and applying a liner to the tips of the corrugated medium to yield a single faced corrugated paper product comprising an elongated fluted roller defining a roller axis and supported at its opposite ends for rotation about said roller axis, forming roller means having flutes which cooperate with said fluted roller to form flutes in said medium as it is passed between said fluted roller and said forming roller means, a plurality of smooth surfaced pressure roll segments, with each of said pressure roll segments defining a pressure segment axis spaced from said roller axis, and means for supporting each of said pressure roll segments for rotation about its respective pressure segment axis and at a location disposed between the opposite ends of said fluted roller, with the periphery of each of said pressure roll segments disposed adjacent the periphery of said fluted roller for accommodating said corrugated medium and said liner as they are passed therebetween.

38. A corrugating machine as set forth in claim 37 wherein said supporting means supports each of said pressure roll segments at an individual location along the length of said fluted roller.

39. A corrugating machine as set forth in claim 37 wherein the pressure segment axis of each of said pressure roll segments extends in a direction substantially parallel to said roller axis.

40. A corrugating machine as set forth in claim 37 wherein said supporting means includes means for adjusting the location of the pressure segment axis of each of said pressure roll segments relative to said roller axis.

41. A corrugating machine as set forth in claim 37 further comprising means for biasing each of said pressure roll segments in the direction of said fluted roller for nip loading each of said pressure roll segments against said fluted roller.

42. A corrugating machine as set forth in claim 41 wherein the nip load applied to an individual pressure roll segment by said biasing means can be varied independently of the nip load applied to other of said pressure roll segments.

43. A corrugating machine as set forth in claim 37 wherein said supporting means further supports each of said pressure roll segments for pivotal movement about a pivot axis with the pressure segment axis of each said pressure roll segment spaced at a radial distance from said pivot axis.

44. A corrugating machine as set forth in claim 43 wherein said pivot axis extends substantially parallel to said roller axis, and each of said pressure segment axes extends substantially parallel to said pivot axis.

45. A corrugating machine as set forth in claim 43 wherein said supporting means further includes means for adjusting the radial distance between said pressure segment axes and said pivot axis.

46. A corrugating machine as set forth in claim 43 wherein said supporting means further includes adjusting means which allows the pressure segment axis of each individual pressure roll segment to be located radially relative to said pivot axis independently of the pressure segment axes of the other of said pressure roll segments.

47. A corrugating machine as set forth in claim 37 wherein said supporting means further supports each of said pressure roll segments for pivotal movement about its own distinct pivot axis spaced from said roller axis.

48. A corrugating machine as set forth in claim 47 wherein each of said distinct pivot axes extends in a direction substantially parallel to said roller axis.

49. A corrugating machine as set forth in claim 48 wherein said supporting means further includes adjustment means for varying the distance between each of said distinct pivot axes and said roller axis as desired.

50. A corrugating machine as set forth in claim 49 wherein said adjustment means enables the distance between the distinct pivot axis of each individual pressure roll segment and said roller axis to be changed independently of the distance between the pivot axes of the other of said pressure roll segments and said roller axis.

51. A corrugating machine as set forth in claim 37 further comprising means for fixing the location of each of said pressure roll segments in the direction of the nip centerline of said pressure roll segment relative to said fluted roller.

52. A corrugating machine as set forth in claim 51 wherein said fixing means comprises a series of mechanical stops which engage said supporting means to positively locate each of said pressure roll segments relative to said fluted roller.

53. A corrugating machine as set forth in claim 51 wherein said fixing means enables each of said pressure roll segments to be positively located relative to said fluted roller independently of the other of said pressure roll segments.

54. A corrugating machine as set forth in claim 51 wherein said fixing means enables the distance between the pressure segment axis of each of said pressure roll segments and said roller axis to be adjusted as desired independently of the distance between the pressure segment axes of the other of said pressure roll segments and said roller axis.

55. A corrugating machine as set forth in claim 37 further comprising means for fixing the location of said pressure roll segments a predetermined clearance distance from said fluted roller but which allows said pressure roll segments to move from said clearance distance and away from said fluted roller to accommodate passage of a foreign object with a dimension greater than said clearance distance between said fluted roller and said pressure roll segments.

56. A corrugating machine as set forth in claim 55 wherein said fixing means enables any one of said pressure roll segments to move from said clearance distance independently of the other of said pressure roll segments.

57. A corrugating machine as set forth in claim 55 wherein said fixing means includes a shear pin component operative to fail to facilitate movement of said pressure roll segments from said clearance distance if said foreign object generates a nip force exceeding a predetermined threshold value.

58. A corrugating machine as set forth in claim 37 wherein said supporting means comprises distinct swing frame structures for supporting each of said pressure roll segments for rotation about its respective pressure segment axis, with each said pressure roll segment and its associated swing frame being independently positionable relative to said roller axis as a separate subassembly.

59. A corrugating machine as set forth in claim 37 wherein said supporting means comprises distinct swing frame structures supported for pivotal movement at separate locations along the length of a pivot shaft spaced from said roller axis, with each of said swing frames supporting a single pressure roll segment for rotating about its respective pressure segment axis and for pivotal movement about said pivot shaft.

60. A corrugating machine as set forth in claim 59 further comprising means for flexing said pivot shaft along its length for simultaneously varying the location of each said swing frame structure and its associated pressure roll segment relative to said roller axis.

61. A corrugating machine as set forth in claim 37 wherein the supporting means for each said pressure roll segment comprises an idler shaft which individually supports said pressure roll segment for rotation about its pressure segment axis, spaced parallel support plates rigidly attached to the opposite ends of said idler shaft adjacent the opposite ends of said pressure roll segment, and a supporting structure to which each said supporting plate is rigidly secured.

62. A corrugating machine as set forth in claim 61 wherein the length of said idler shaft is less than the length of said pressure roll segment, and the opposite ends of said pressure roll segment are relieved radially inwardly of its outer peripheral surface to define recesses within which said support plates are received for attachment to the opposite ends of said idler shaft.

63. A corrugating machine as set forth in claim 62 wherein the radially outer periphery of each end of said pressure roll segment is operative to be received within and move through an annular recess formed within the adjacent support plate as said pressure roll segment rotates about its pressure segment axis.

64. A corrugating machine as set forth in claim 63 wherein the annular recess of each said support plate is disposed radially between the point at which the support plate is rigidly attached to said idler shaft and the point at which the support plate is rigidly secured to said supporting structure.

65. A corrugating machine for forming corrugations in a paper medium and applying a liner to the tips of the corrugated medium to yield a single faced corrugated paper product, comprising an elongated fluted roller supported at its opposite ends for rotation about a roller axis, a plurality of discrete forming rollers disposed at separate locations spaced along the length of said fluted roller, with each of said forming rollers being individually supported for rotation about its own distinct axis of rotation spaced from said roller axis and having flutes operative to intermesh with the flutes of said fluted roller and to cooperate therewith to form corrugations in said medium as said medium is passed between said fluted roller and said forming roller, and a plurality of discrete smooth surfaced pressure rollers disposed at separate locations spaced along the length of said fluted roller, with each of said pressure rollers being individually supported for rotation about its own distinct pressure roll axis spaced from said roller axis and with its peripheral surface disposed adjacent the periphery of said fluted roller for accommodating said medium and said liner as they are passed between said fluted roller and said pressure roller.

66. A corrugating machine as set forth in claim 65 wherein the axis of rotation of each of said forming rollers extends in a direction substantially parallel to said roller axis.

67. A corrugating machine as set forth in claim 66 wherein the axis of rotation of each of said forming rollers is independently positionable relative to said roller axis for varying the timing of the formation of corrugations in said medium at different locations along the direction of said roller axis.

68. A corrugating machine as set forth in claim 65 further comprising means for biasing each of said forming rollers for nip loading each of said forming rollers against said fluted roller.

69. A corrugating machine as set forth in claim 68 wherein the individual nip load applied by said biasing means to any one of said forming rollers can be adjusted independently of the nip loads applied to the other of said forming rollers.

70. A corrugating machine as set forth in claim 65 further comprising limit means for preventing movement of said forming rollers toward said fluted roller beyond a predetermined minimum threshold distance from said fluted roller.

71. A corrugating machine as set forth in claim 70 wherein said limit means enables said predetermined minimum threshold distance to be set and varied for each of said forming rollers independently of the other of said forming rollers.

72. A corrugating machine as set forth in claim 65 wherein the pressure roll axis of each of said pressure rollers extends in a direction substantially parallel to said roller axis.

73. A corrugating machine as set forth in claim 72 wherein the pressure roll axis of each of said pressure rollers is independently positionable relative to said roller axis for varying the location of the nip centerline between said fluted roller and each of said pressure rollers.

74. A corrugating machine as set forth in claim 65 further comprising means for biasing each of said pressure rollers for nip loading each of said pressure rollers against said fluted roller.

75. A corrugating machine as set forth in claim 74 wherein the individual nip load applied by said biasing means to any one of said pressure rollers can be adjusted independently of the nip loads applied to the other of said pressure rollers.

76. A corrugating machine as set forth in claim 65 further comprising limit means for preventing movement of said pressure rollers toward said fluted roller beyond a predetermined minimum threshold distance from said fluted roller.

77. A corrugating machine as set forth in claim 76 wherein said limit means enables said predetermined threshold distance to be set and varied for each of said pressure rollers independently of the other of said pressure rollers.

78. A corrugating machine for forming corrugations in a paper medium having upper and lower corrugating roller assemblies which cooperatively define a medium entry location and a medium exit location and which are operative to form corrugations in a paper medium passed between said entry location and said exit location, with said lower corrugating roller assembly being comprised of an elongated fluted roller supported for rotation at its opposite ends, and said upper corrugating roller assembly comprising a plurality of discrete fluted forming roll segments of different diameters supported for rotation at separate stations spaced along the length of said fluted roller, with each of said forming roll segments cooperatively defining with said lower corrugating roller a distinct nip centerline disposed at a location between said entry location and said exit location and through which a portion of said medium passes.

79. A corrugating machine as set forth in claim 78 wherein the diameters of said forming roll segments vary in accordance with the location of their respective associated nip centerlines relative to said entry location.

80. A corrugating machine as set forth in claim 79 wherein said forming roll segments define progressively smaller diameters the closer their nip centerlines are disposed to said entry location.

81. A corrugating machine for forming a corrugated medium and applying a liner to said corrugated medium to yield a single faced corrugated paper product comprising an upper corrugating roller assembly, a lower corrugating roller assembly which cooperates with said upper corrugating roller assembly to form said corrugated medium, and a pressure roller assembly which cooperates with said lower corrugating roller assembly to define an entry location and an exit location through which said corrugated medium and said liner are passed and between which said liner is applied to said corrugated medium, with said pressure roller assembly comprising a plurality of discrete pressure roll segments of different diameters supported for rotation adjacent said lower corrugating roller assembly at separate stations spaced along the length of said lower corrugating roller assembly, with each of said pressure roll segments cooperatively defining with said lower corrugating roller assembly a distinct nip centerline disposed at a location between said entry location and said exit location and through which a portion of said corrugated medium and said liner pass.

82. A corrugating machine as set forth in claim 81 wherein the diameters of said pressure roll segments vary in accordance with the location of their respective associated nip centerlines relative to said entry location.

83. A corrugating machine as set forth in claim 82 wherein said pressure roll segments define progressively smaller diameters the closer their nip centerlines are disposed to said entry location.

84. A corrugating machine for forming corrugations in a paper medium comprising an elongated fluted roller supported at its opposite ends for rotation about a first axis, a forming roller assembly having a plurality of fluted roll segments which cooperate with said fluted roller to form corrugations in said paper medium, and means for supporting said forming roll assembly for pivotal movement relative to said first axis for simultaneously adjusting the circumferential location of each said fluted roll segment relative to said fluted roller.

85. A corrugating machine for forming a corrugated paper medium and applying a liner to the tips of the corrugated medium to yield a single faced corrugated paper product comprising an elongated fluted roller supported at its opposite ends for rotation about a first axis, forming roller means having flutes which cooperate with said fluted roller to form flutes in said medium as it is passed between said fluted roller and said forming roller means, a pressure roller assembly having a plurality of smooth surfaced pressure roll segments, with the periphery of each of said pressure roll segments being disposed adjacent the periphery of said fluted roller for accommodating said corrugated medium and said liner as they are passed therebetween, and means for supporting said pressure roller assembly for pivotal movement relative to said first axis for simultaneously adjusting the circumferential location of each said pressure roll segment relative to said fluted roller.

* * * * *

UNITED STATES PATENT AND TRADEMARK OFFICE

CERTIFICATE OF CORRECTION

PATENT NO. : 4,531,996

DATED : July 30, 1985

INVENTOR(S) : Robert J. Sukenik

It is certified that error appears in the above-identified patent and that said Letters Patent is hereby corrected as shown below:

| | |
|---|---|
| Col. 1, line 57 | "comodate" should be --commodate-- |
| Col. 2, line 21 | "occurs" should be --costs-- |
| Col. 6, line 5 | "clearly" should be --fully-- |
| Col. 6, line 22 | "be" should be --by-- |
| Col. 10, line 14 | "medium" should be --machine-- |
| Col. 11, line 33 | "an" should be --and-- |
| Col. 13, line 54 | "moment" should be --movement-- |
| Col. 24, line 45 | insert --minimum-- before "threshold" |

Signed and Sealed this

*Seventeenth* Day of *June 1986*

[SEAL]

*Attest:*

DONALD J. QUIGG

*Attesting Officer*

*Commissioner of Patents and Trademarks*